United States Patent [19]

Voss et al.

[11] Patent Number: 4,909,313

[45] Date of Patent: Mar. 20, 1990

[54] PRESSURIZED BELLOWS FLAT CONTACT HEAT EXCHANGER INTERFACE

[75] Inventors: Fred E. Voss, Mansfield; Harold R. Howell, Arlington; Roger V. Winkler, Ft. Worth, all of Tex.

[73] Assignee: The United States of America as represented by the Administrator, National Aeronautics and Space Administration, Washington, D.C.

[21] Appl. No.: 252,077

[22] Filed: Sep. 30, 1988

[51] Int. Cl.[4] ..... F28F 27/00

[52] U.S. Cl. ..... 165/78; 165/96; 165/46; 165/32

[58] Field of Search ..... 165/32, 96, 46, 78

[56] References Cited

U.S. PATENT DOCUMENTS

| | | | |
|---|---|---|---|
| 3,225,820 | 12/1965 | Riordan | 165/268 |
| 3,450,196 | 6/1969 | Bauer | 165/32 |
| 3,463,224 | 8/1969 | Myers | 165/32 |
| 3,478,819 | 11/1969 | Reinke | 165/32 |
| 3,807,188 | 4/1974 | Lagodmos | 62/514 |
| 3,957,107 | 5/1976 | Altoz et al. | 165/32 |
| 4,067,042 | 1/1978 | Novak et al. | 357/82 |
| 4,454,910 | 6/1984 | Miyazaki | 165/32 |
| 4,660,132 | 4/1987 | Basler et al. | 165/78 |
| 4,676,300 | 6/1987 | Miyazaki | 165/32 |

*Primary Examiner*—Albert W. Davis, Jr.

*Attorney, Agent, or Firm*—Edward K. Fein; John R. Manning; Russell E. Schlorff

[57] ABSTRACT

Disclosed is an interdigitated plate-type heat exchanger interface. The interface includes a modular interconnect to thermally connect a pair or pairs of plate-type heat exchangers to a second single or multiple plate-type heat exchanger. The modular interconnect comprises a series of parallel, plate-type heat exchangers arranged in pairs to form a slot therebetween. The plate-type heat exchangers of the second heat exchanger insert into the slots of the modular interconnect. Bellows are provided between the pairs of fins of the modular interconnect so that when the bellows are pressurized, they drive the plate-type heat exchangers of the modular interconnect toward one another, thus closing upon the second heat exchanger plates. Each end of the bellows has as a part thereof a thin, membrane diaphragm which readily conforms to the contours of the heat exchanger plates of the modular interconnect when the bellows is pressurized. This ensures an even distribution of pressure on the heat exchangers of the modular interconnect thus creating substantially planar contact between the two heat exchangers. The effect of the interface of the present invention is to provide a dry connection between two heat exchangers whereby the rate of heat transfer can be varied by varying the pressure within the bellows.

7 Claims, 2 Drawing Sheets

PRESSURIZED BELLOWS FLAT CONTACT HEAT EXCHANGER INTERFACE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

1. Field of the Invention

This invention relates generally to heat exchangers and more particularly to contact interfaces between two heat exchangers.

2. Background Art

There is taught a thermal operated circuit controlling device in U.S. Pat. No. 2,109,169. The device provides for adjustment of the time of operation of bi-metallic thermal elements enclosed in an evacuated or gas filled bulb. A diaphragm is provided as a means of varying the pressure within the device for the purpose of adjusting the operating time of a thermally operated circuit controller.

In U.S. Pat. No. 3,225,820 there is taught a device for maintaining the operating temperature of an electronic component by controlling the rate at which the heat generated within the component is allowed to dissipate. A bellows containing an expansive medium expands and contracts to vary an air gap, the bellows itself serving as a heat conductor and the width of the air gap serving to control the resistance to heat dissipation.

A heat valve is taught in U.S. Pat. No. 3,391,728. The heat valve is formed in the gap between the heat source and a heat sink. The gap is capped on one end by a pressurized gas reservoir and on the opposite end by a bellows containing a liquid thermal conductor. By varying the level of the liquid thermal conductor, the conduction of heat across the gap can be controlled.

In U.S. Pat. No. 3,450,196 there is taught an apparatus which uses gas pressure control to vary thermal conductivity. A heat radiating component is surrounded with multiple layers of thermal insulation with the outer layer of the thermal insulation being a pressurizable container. Gas or liquid may be passed between the layers of thermal insulation and by varying the pressure of the gas or liquid, the thermal conductivity of the gas or liquid is varied resulting in a regulation of the heat loss of the component.

In U.S. Pat. No. 3,463,224 there is described a heat transfer switch which utilizes a contained fluid, a bellows and heat conducting plate. As the temperature of the fluid is increased, it expands filling the bellows with the bellows in turn elongating and driving one thermal conducting plate to contact another.

In U.S. Pat. No. 3,478,819 there is taught a variable heat conductor for use in space vehicles. A thermal responsive element is used to drive an actuator causing a piston to contact a heat sink.

A thermal coupling device for use in cryogenic refrigeration is taught in U.S. Pat. No. 3,807,188. The device incorporates a mercury filled bellows. When the mercury freezes the bellows clamps around a thermal transfer neck, thus providing a coupling between a refrigerant source and a device to be refrigerated.

A double tube heat exchanger is taught in U.S. Pat. No. 3,907,026. The heat exchanger is conventional in that heat is transferred from a primary fluid to a secondary fluid. The tubes through which the fluids flow are interdigitated.

Building panels having controllable insulating capabilities are taught in U.S. Pat. No. 3,920,953. The panels comprise a pair of walls which can be moved toward or away from each other to vary the insulating properties of the panels. Air is used to inflate flexible ducts residing between the walls, thus driving the walls further apart to increase the insulating properties of the panel. Deflating the flexible ducts draws the walls together and decreases the insulating properties of the panel.

U.S. Pat. No. 3,957,107 teaches yet another thermal switch connecting a heat sink to a heat source. An expandible bellows encloses a refrigerant. As the bellows assembly is heated, the refrigerant vaporizes expanding the bellows and connection the heat circuit between the heat sink and the heat source.

Yet another heat controlling device utilizing a bellows arrangement is taught in U.S. Pat. No. 4,454,910. As with some other patents discussed above, the bellows encloses a working fluid with a relatively high vapor pressure As the working fluid is heated, the resultant vapor pressure causes the bellows to expand thereby driving a contact plate toward a radiating plate. Heat from a heat source is then transmitted through the working fluid and the contact plate to the radiating plate.

Although it can be seen that heat transfer devices have incorporated bellows to drive contacting plates together to complete a heat circuit, the use of a bellows has not been incorporated to drive multiple plate-type heat exchangers into contact with a second plate-type heat exchanger in an interdigitated arrangement. Further, nowhere has there previously been used a thin membrane diaphragm forming an end portion of the bellows to allow the surface of the membrane diaphragm to conform to any contours in the heat exchanger plates thereby applying a uniform contact pressure between the heat exchangers. The result is a dry, efficient heat transfer where the rate of heat transfer can be varied by varying the pressure within the bellows.

SUMMARY OF THE INVENTION

Accordingly, it is therefore an object of the present invention to provide an apparatus for thermally coupling two interdigitated plate-type heat exchangers.

A further object of the present invention is to provide an apparatus for heat transfer between two fluid loops without using fluid connections.

Another object of the present invention is to provide a bellows driven conformable membrane diaphragm which when pressurized drives the plates of two interdigitated plate-type heat exchangers into contact interface.

Still another object of the present invention is to form the area of the bellows in contact with the plates of the heat exchangers as a thin membrane diaphragm which conforms to the surface contours of the attached plate so that a uniform pressure is applied to the plate thus ensuring substantially full planar contact between interfacing plates.

Briefly stated, the foregoing and numerous other features, objects and advantages of the present invention will become readily apparent upon a reading of the detailed description, claims and drawings set forth hereinafter. These features, objects and advantages are accomplished by providing for an interdigitated heat exchanger interface between two heat exchangers. In essence, a male/female type connection is made between a first heat exchanger surface and a modularized interconnect containing the second heat exchanger surface. The plates of the first heat exchanger are inserted into the slots created in the modularized interconnect between pairs of heat exchanger plates of the modularized interconnect.

A pressurized bellows arrangement is provided to drive the heat exchanger plates into substantially full planar contact with one another, thus providing a dry, efficient, thermal contact conduction interface between two heat exchangers. Each bellows arrangement features a thin membrane diaphragm forming a part of the pressurized bellows where the pressurized bellows attaches to the plates of the modularized interconnect. As the bellows are pressurized, the thin diaphragm conforms to the surface contours of the attached plate to provide efficient heat transfer. By varying the pressure of the fluid within the bellows, the thermal contact conductance and thus, the rate of heat transfer can also be varied.

DETAILED DESCRIPTION OF THE PREFERRED EMBODIMENTS

Figure 1:
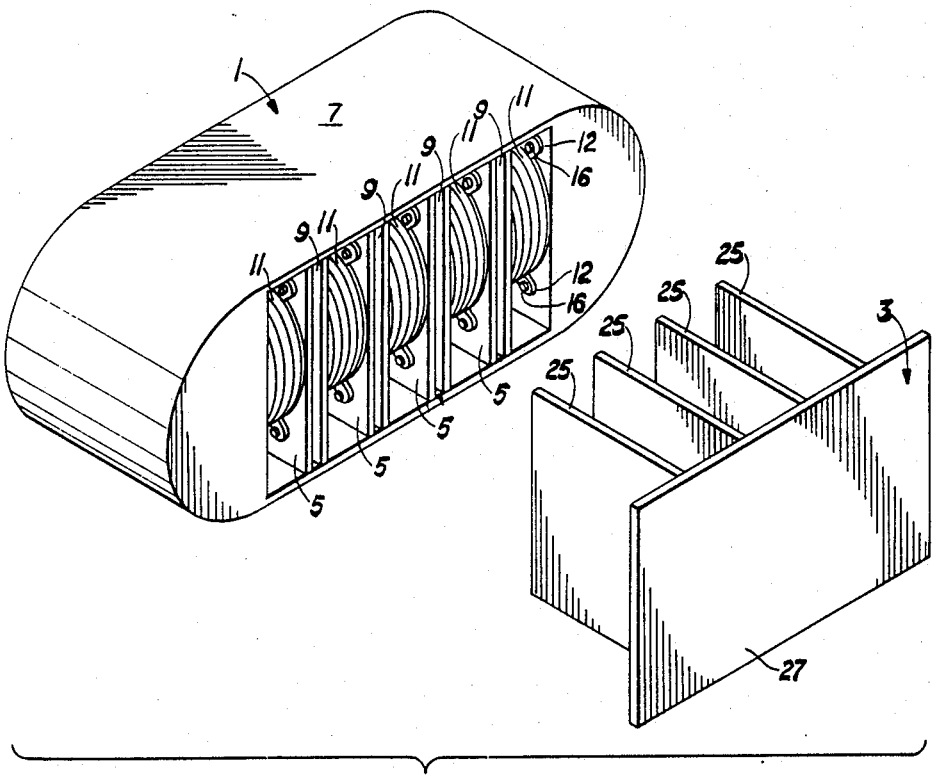
FIG. 1 is an isometric view of the interface of the present invention in disengaged position.
Figure 3:
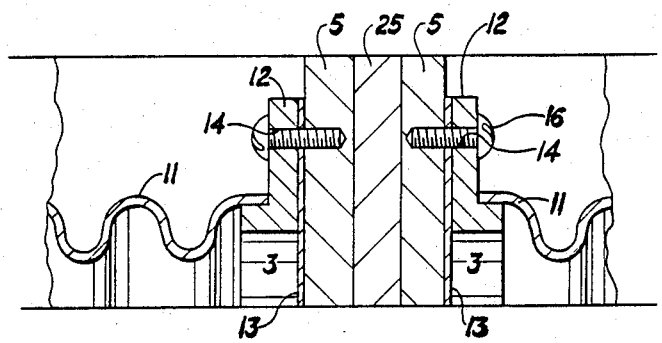
FIG. 3 is a detail drawing showing the connection of the bellows to the heat exchanger plates.
Figure 2:
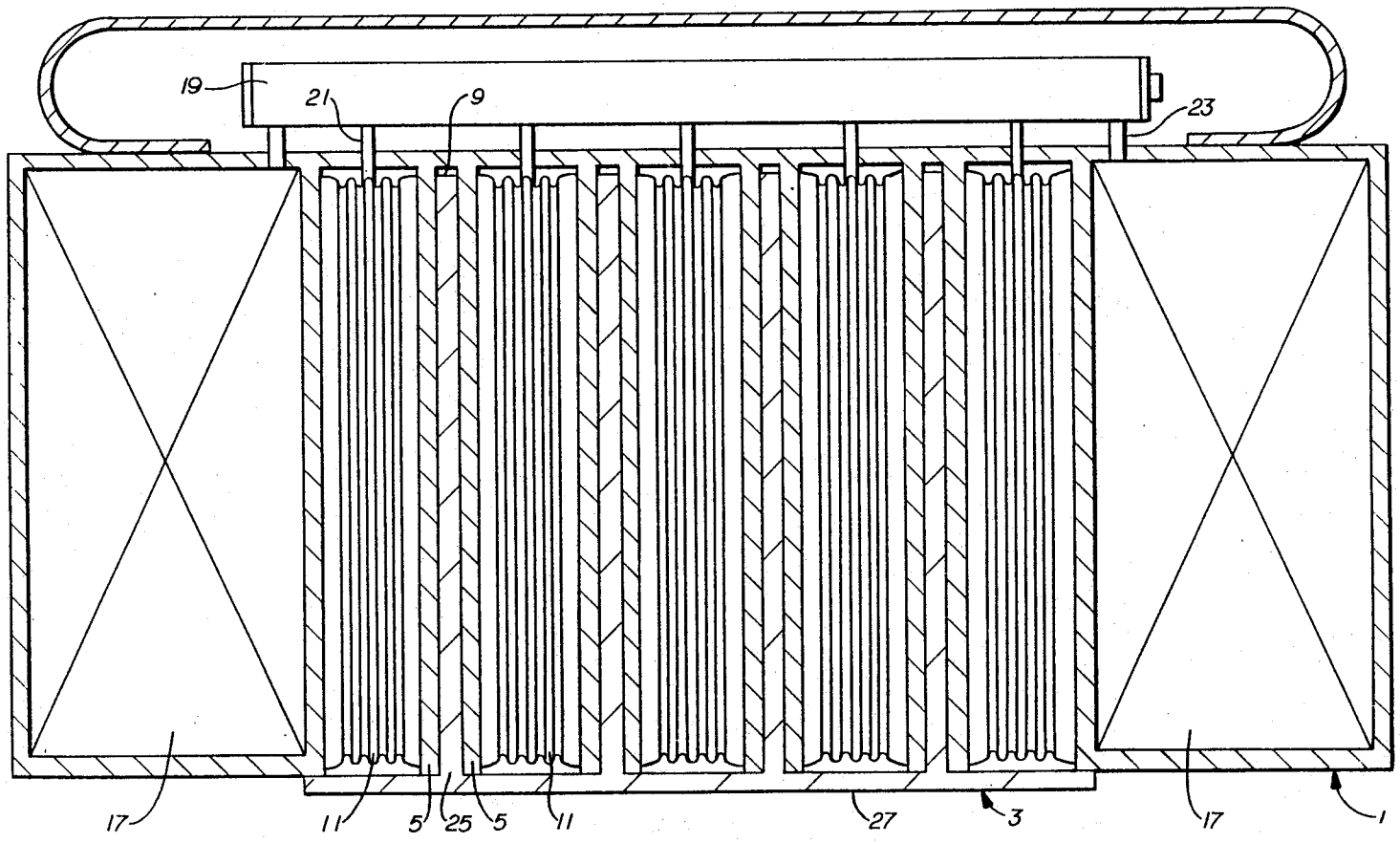
FIG. 2 is a cross-sectional view of the interface.

Turning first to FIG. 1, there is shown a modularized heat exchanger interconnect 1 and a set of heat exchangers 3. Modularized interconnect 1 contains the plates 5 of a plate-type heat exchanger. The plates 5 are arranged in pairs within containment structure 7. Plates 5 are rectangular and form an array of spaced pairs of plates 5. A slot 9 is present in between the plates 5 of each pair. Also housed within containment structure 7 are a plurality of bellows 11. Each bellows 11 attaches to two plates 5 on the faces of plates 5 opposite slots 9. The ends of each bellows 11 are provided with a plurality of peripheral projections 12 with apertures 14 therein. Screws or bolts 16 extend through apertures 14 to attach bellows 11 to plates 5. The end portions of each bellows 11 which contact plates 5 are thin membrane diaphragms 13. The ends 15 of containment structure 7 enclose a perforated honeycomb structure 17 which pressurizes simultaneously with bellows 11 during operation to provide lateral containment support within containment structure 7. Perforated honeycomb structure 17 is preferably an open celled metallic honeycomb.

The bellows material is chosen depending upon the service an conditions under which the interface is operated. Contingent on such factors, the bellows material may range from steel to titanium. Thickness of the membrane diaphragm 13 is governed by the conformability under pressure of the particular material chosen. For example, if titanium is the chosen bellows material, it has been found that a thickness of 0.01 inches is acceptable for membrane diaphragms 13.

Modular interconnect 1 is provided with a pressurized fluid manifold 19 connected to each bellows 11 by means of flexible conduits 21. Manifold 19 also connects to perforated honeycomb pressurized end structures 17 by means of conduits 23.

Heat exchanger 3 is comprised of a plurality of rectangular heat exchanger plates 25 extending from a support plate 27. Rectangular plates 25 are the first heat exchanger which may, for example, be an ammonia heat exchanger. Plates 5 located within containment structure 7 are the second heat exchanger which may be, for example, a water heat exchanger.

In operation, plates 25 insert into slots 9 of modular interconnect 1, thus creating a dry, flat contact heat exchanger interface. Bellows 11 and perforated honeycomb end structures 17 are pressurized with fluid, for example nitrogen, through manifold 19. As bellows 11 are pressurized, they expand driving plates 5 into contact with plates 25. Thin membrane diaphragm 13 which forms the end portions of bellows 11 conforms to the surface contours of attached plate 5, thus ensuring a uniform pressure exerted on plates 5. The result is a uniform pressure thermal contact conduction interface between plates 5 and plates 25. The thermal contact conductance and therefore, the rate of heat transfer can be varied by varying the pressure of the fluid to the bellows 11 and perforated honeycomb end structures 17. The greater the pressure, the greater the conductance. The metallurgy of plates 5 and 25 may be any metallurgy typically used in plate-type heat exchangers such as, for example, steel or aluminum.

From the foregoing, it can be seen that the flat contact heat exchanger interface of th present invention provides an efficient and dry means of providing a contact interface between two heat exchangers. Clearly the interface of the present invention is advantageous over a typical connectable/disconnectable fluid interface which provides many opportunities for leaks to occur. This advantage becomes more apparent when it is realized that quite often the fluids contained within the heat exchangers are corrosive requiring a special metallurgy. With the present invention, if one of the fluids is corrosive, only that heat exchanger containing the corrosive fluid be made of the required special metallurgy. The second heat exchanger containing the non-corrosive fluid need not be manufactured from a special metal because the interface between the two heat exchangers is dry.

Yet another advantage of the present invention is the modularized interconnect which allows one heat exchanger to be easily replaced without disturbing the second heat exchanger. This situation could develop for example, when one heat exchanger develops leaks or becomes fouled. Other than disconnecting the interface between the two exchangers, all other connections, fluid or otherwise, to the non-leaking exchanger may remain in place. Replacement of the leaking or fouled heat exchanger thus becomes both cost and time efficient as a result of the dry modularized interface.

An additional advantage of the interface of the present invention is the capability of varying heat loads or changing thermal flow loops while maintaining a constant fluid flow condition of a central thermal transport loop. The bellows pressure can be reduced so that contact between plates 5 and 25 is no longer maintained, thereby eliminating heat transfer without shutting down circulating pumps or closing valves. Similarly, the temperature control of a fluid loop can be regulated by a variation of bellows pressure which, as stated above, affects the heat transfer rate across the exchanger interface.

From the foregoing, it is seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. A heat exchanger interface for thermally connecting two plate-type heat exchangers comprising:

a first array of parallel, spaced, plate-type heat exchangers arranged in pairs to provide a slot between said plates of each of said pairs;

a second array of parallel, spaced, plate-type heat exchangers being engageable to and disengageable from said first array by insertion of said plates of said second array into said slots of said first array;

a bellows residing between each of said pairs of said plates of said first array, said bellows being connected to a source of pressurized fluid so that said plates of said first array can be driven into substantially planar contact with said plates of said second array by increasing the pressure within said bellows;

a manifold residing between said source of pressurized fluid and said bellows, said manifold having a plurality of flexible conduits extending therefrom or supplying pressurized fluid to said bellows.

2. An interface for interconnecting two plate-type heat exchangers as recited in claim 1 further comprising:

a thin, membrane diaphragm forming each end of each of said bellows, said membrane diaphragms deforming to effect substantially planar contact with said plates of said modular interconnect when said bellows are pressurized.

3. An interface for interconnecting two plate-type heat exchangers as recited in claim 1 wherein:

each of said bellows includes two end portions, both of said end portions being deformable membrane diaphragms, said end portions being affixed to said heat exchanger plates of said modular interconnect.

4. An interface for connecting two plate-type heat exchangers as recited in claim 1 wherein:

said heat exchanger plates of said modular interconnect and said heat exchanger plates of said second heat exchanger are substantially rectangular.

5. An interface for connecting two plate-type heat exchangers as recited in claim 1 further comprising:

a containment structure enclosing said modular interconnect.

6. An interface for connecting two plate-type heat exchangers as reacted in claim 5 further comprising:

an end structure enclosed within said containment structure adapted to receive pressurized fluid thereby providing containment support to said plate-type heat exchangers when said bellows are pressurized.

7. An interdigitated plate-type heat exchanger interface for connecting two heat exchangers comprising:

a heat exchanger including at least one plate-type fin;

a modular interconnecting including a heat exchanger with at least one pair of parallel, plate-type fins arranged to form a slot therebetween;

a bellows residing on each side of said pair of parallel, plate-type fins, each of said bellows terminating in a thin, membrane diaphragm which forms a part of said bellows;

a means for supplying pressurized gas to said bellows so that said fins of said modular interconnect can be driven into substantially planar contact with said fin of said thermal bus;

a manifold residing between said means for supplying pressurized gas and said bellows, said manifold having a plurality of flexible conduits extending therefrom to said bellows.

* * * * *